United States Patent [19]

Weishaupt et al.

[11] 4,162,888

[45] Jul. 31, 1979

[54] BURNER FOR LIQUID FUELS

[76] Inventors: Siegfried Weishaupt; Hermann Kopp, Biberacherstr. 54, both of D-7959 Schwendi, Württ., Fed. Rep. of Germany

[21] Appl. No.: 888,664

[22] Filed: Mar. 21, 1978

[30] Foreign Application Priority Data

Mar. 22, 1977 [DE] Fed. Rep. of Germany ..... 2712564

[51] Int. Cl.[2] ..... F23Q 3/00; F23C 5/06

[52] U.S. Cl. ..... 431/265; 239/417; 431/183; 431/189

[58] Field of Search ..... 431/265, 266, 264, 183, 431/189; 239/417, 416

[56] References Cited

U.S. PATENT DOCUMENTS

| | | | |
|---|---|---|---|
| 2,485,244 | 10/1949 | Sanborn | 431/265 |
| 3,126,939 | 3/1964 | De Lancey | 431/265 |
| 3,485,452 | 12/1969 | Sborlino | 239/417 |
| 3,615,053 | 10/1971 | Pease et al. | 239/417 |

FOREIGN PATENT DOCUMENTS

| | | | |
|---|---|---|---|
| 7984/32 | 9/1933 | Australia | 239/417 |
| 240905 | 8/1969 | Bulgaria | 431/183 |
| 2114619 | 10/1972 | Fed. Rep. of Germany | 431/183 |
| 783707 | 7/1935 | France | 239/417 |
| 7526230 | 8/1974 | France | 431/265 |

*Primary Examiner*—Samuel Scott
*Assistant Examiner*—William R. Henderson
*Attorney, Agent, or Firm*—Max Fogiel

[57] ABSTRACT

A burner for liquid fuel in which a pressure atomizer jet is located concentrically in an air supply pipe. A potlike body is located between the discharge opening of the air supply pipe and the discharge opening of the burner jet. The body or member is opened towards the combustion chamber, and has a shell having radial openings and extending to the discharge opening of the air supply type for closing it. The potlike member has a bottom constructed as a baffle plate with a center opening and radial slots emanating from it. Upstream of this baffle plate, there is located another potlike member which encloses a space containing the atomizer jet and the ignition electrodes. The bottom of the other potlike member is penetrated by a pipe whose discharge opening is downstream of the ignition electrodes between them. The diameter of the rim of the other potlike member is smaller than the diameter measured by the outer ends of the radial slots and is larger than the diameter of the center opening of the baffle plate. Slots extending in the peripheral direction are provided between the radial openings and the edge of the bottom of the first potlike member which forms the baffle plate.

4 Claims, 2 Drawing Figures

BURNER FOR LIQUID FUELS

BACKGROUND OF THE INVENTION

The present invention relates to a burner for liquid fuels, with at least one atomizer jet which is located concentrically in an air supply pipe, with a potlike body located between the discharge opening of the burner jet and open towards the combustion chamber. The shell of this body, having radial openings, extends to the discharge opening of the air supply pipe and closes it; its bottom is constructed as a baffle plate having a center opening and radial slots emanating from there. Burners of this type are known (German Laid-Open Documents No. 2,049,168, No. 2,358,737 and No. 2,546,917). The known burners of this type have proven performance when they are laid out for a certain consumption, for example from 1.8 to 3.0 kg/hr. If this consumption is to be less, for example, only 1 kg/hr, the dimensions of the burner head had to be reduced; if a higher consumption is to be attained, if, for example, 10 kg/hr were to be burnt, the dimensions of the burner head had to be increased accordingly.

It is the object of the present invention to develop the above burner heads further so that, with the dimensions remaining the same, by slight changes, they can operate with a relatively small oil consumption, for example, 1 kg/hr, with a medium oil consumption of 1.8 to 3 kg/hr and with a higher oil consumption of, for example, 10 kg/hr.

SUMMARY OF THE INVENTION

This object of the present invention is achieved as follows: Upstream of the baffle plate there is an additional potlike body which closes off the space containing the atomizer jet and the ignition electrodes. Its bottom and shell enclose a pipe or similar item carrying combustion air whose discharge is upstream between the ignition electrodes. The diameter of the rim of the additional pot is smaller than the diameter determined by the outer ends of the radial slots and larger than the diameter of the center opening of the baffle plate. If the burner head is constructed this way, relatively small oil quantities, for example, 1 kg/hr can be burnt with it. With the burners of the known type, both during start and during operation, a relatively large amount of relatively cold air flows through the center opening of the baffle plate towards the combustion chamber and carries the atomized oil droplets into the combustion chamber, without them evaporating, closing off the space enclosing the atomizer jet. The ignition electrodes produce downstream of the baffle plate an underpressure region with relatively large underpressure of relatively large volume, because the air flowing through the outer region of the radial slots produces a rotating hollow air column having underpressure in the middle. The combustion gases developing after ignition are sucked back into this underpressure region. Since combustion air is introduced through the radial openings of the potlike body and flows through the combustion gases being moved back, this combustion air also is moved back in the direction towards the discharge of the atomizer jet and mixes with the exiting fuel jets so that soot-free combustion is achieved.

If a larger oil quantity is to be burnt, for example, 1.8 to 3 kg/hr, it is merely necessary to locate slots between the shell of the pot-like body having radial openings and the rim of the bottom forming the baffle plate; these slots extend in the peripheral direction. This results in a larger underpressure and hence an increased backflow.

If an even larger oil quantity, for example, 8 to 10 kg/hr are to be burnt, it is advisable to make the potlike body closing off the air supply pipe from two parts. One of these parts comprises part of the shell and the bottom constructed as baffle plate; the other part comprises the portion of the shell having the radial openings, is connected on one end to the air supply pipe and axially displaceable with it. On its other end facing the twist bucket ring (baffle plate) it has an end cone expanding in the upstream direction.

If these two parts of the potlike body are in contact, the burner head is suited for burning medium quantities, for example, 1.8 to 3 kg/hr. If the two parts are pulled apart, preferably by shifting the air supply pipe, the same burner head is suited for burning larger oil quantities, for example, 10 kg/hr.

If the burner is constructed as a swing-out burner, it is advisable to construct the additional pot mentioned above in two sections. One section is fastened to the baffle plate, the other section, under spring pressure, is displaceable on the jet tube. When the burner is not swung out, the two sections abut each other.

DESCRIPTION OF THE PREFERRED EMBODIMENTS

Figure 1:
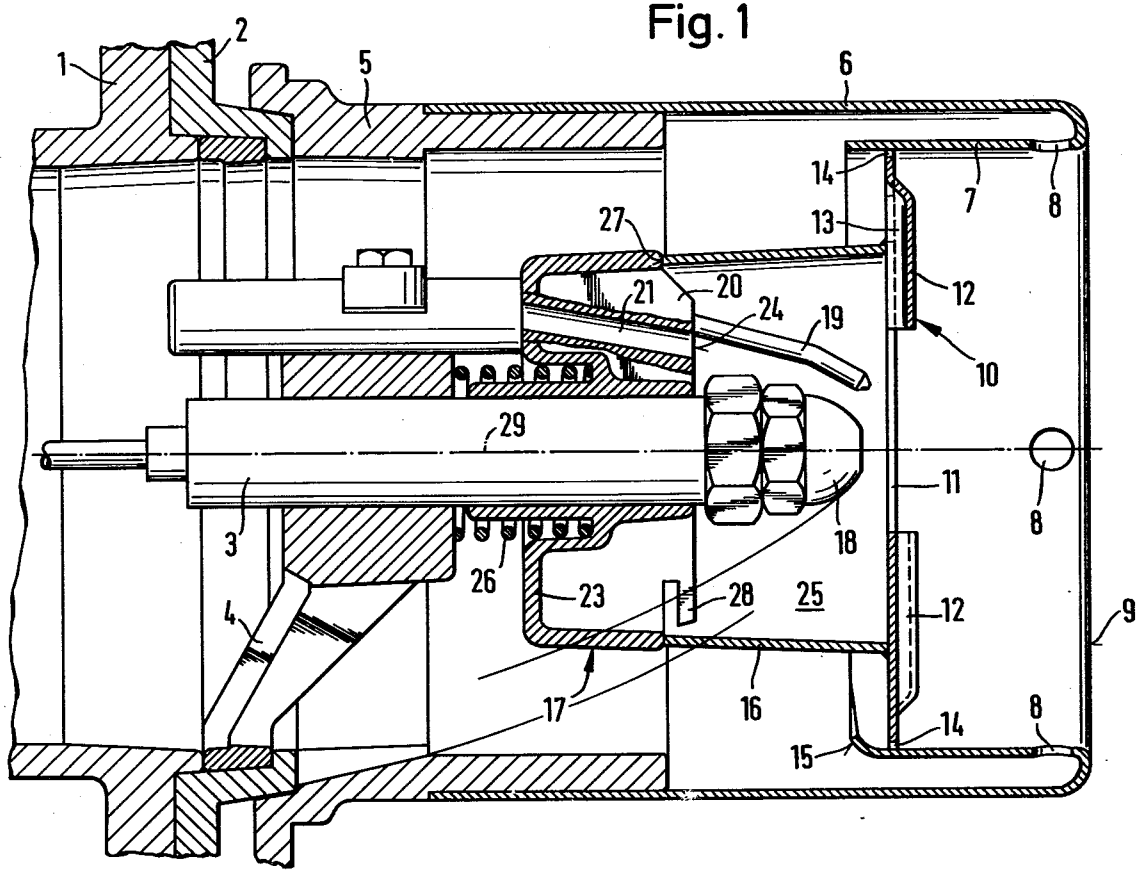
FIG. 1 shows a section view through a burner head (tip) for an oil consumption of about 1.8 to 3 kg/hr.

For the embodiment of FIG. 1 it is assumed that the burner is constructed as a swing-out burner. The burner housing 1 connects to a face plate 2 to which the jet tube 3 is fastened via struts 4. The above parts can be swung out from a support 5. The support 5 holds an air supply pipe 6 which in the region of its discharge is reduced to a smaller diameter and therefore forms a hollow cylinder 7 there.

The shell of this hollow cylinder contains several radial drill holes 8, in the vicinity of the discharge 9 of the air supply pipe. Shell 7, together with a baffle plate 10, forms a potlike body. The baffle plate 10, besides a center opening 11 has radial slots 13 covered by scoops 12 as are known in the art for baffle plates. Bottom and shell are not made of one piece, but of two sections because between bottom and shell 7 there are slots 14 extending in the peripheral direction, due to burner head being arranged for a medium consumption of 1.8 to 3 kg/hr. If the slots 14 were omitted, if, for example, the baffle plate 10 is made of one-piece with the shell 7, and shell 7 would be welded to the air supply pipe 6 in the vicinity of discharge opening 9, relatively small oil quantities, for example, 1 kg/hr, could be burned with such a burner. In the present case, the shell 7 is extended upstream beyond the baffle plate 10, so that, as shown in the lower portion of FIG. 1, dripping oil can be led out from the air supply pipe. Accordingly, this projecting portion in the bottom section is provided with a flange (crimp) 15.

A slightly conical hollow body 16, which converges upstream, is welded to the baffle plate 10. This hollow body 16, with a hollow body 17 closed on the upstream side, forms a space containing the atomizer nozzle (jet) 18 and the ignition electrodes 19, of which only one is shown. Between the two electrodes is a web 20 which has a passage 21. This passage 21 passes through the bottom 23 of the closed hollow body 17, its other discharge opening 24 is positioned so that it moves the ignition spark produced between the electrodes into the jet stream of the atomizer jet 18. Through the closed space 25, just enough combustion air required for moving the ignition spark will pass. The hollow body 17, being one-piece with the bottom 23, is movably placed on the jet tube 3, under the action of a spring, and tends to touch the hollow body 16 in the vicinity of its end surface 27. In order to carry away dripping oil, the hollow body 17 has a drip catch 28, and hence dripping oil is carried away via stationary parts of the burner.

If the jet head has been swung out, for example, to replace the atomizer jet by another, and if the jet head is swung in again, spring 26 ensures that the hollow body 17 forms with hollow body 16 a closed space which receives air steadily supplied through passage 21. Instead of a web 20 with passage 21, a pipe may also be provided. This pipe may pass through either the bottom 23 or the shell of hollow body 17 or the shell of hollow body 16. It is only important that its discharge is placed in the area of the ignition electrodes in such a way that the ignition spark is blown into the fuel jet. As shown in FIG. 1, the center opening 11 of baffle plate 10 is offset upwardly in relation to the jet axis 29, so that the atomizer jet can also operate with a relatively large atomizing angle.

Figure 2:
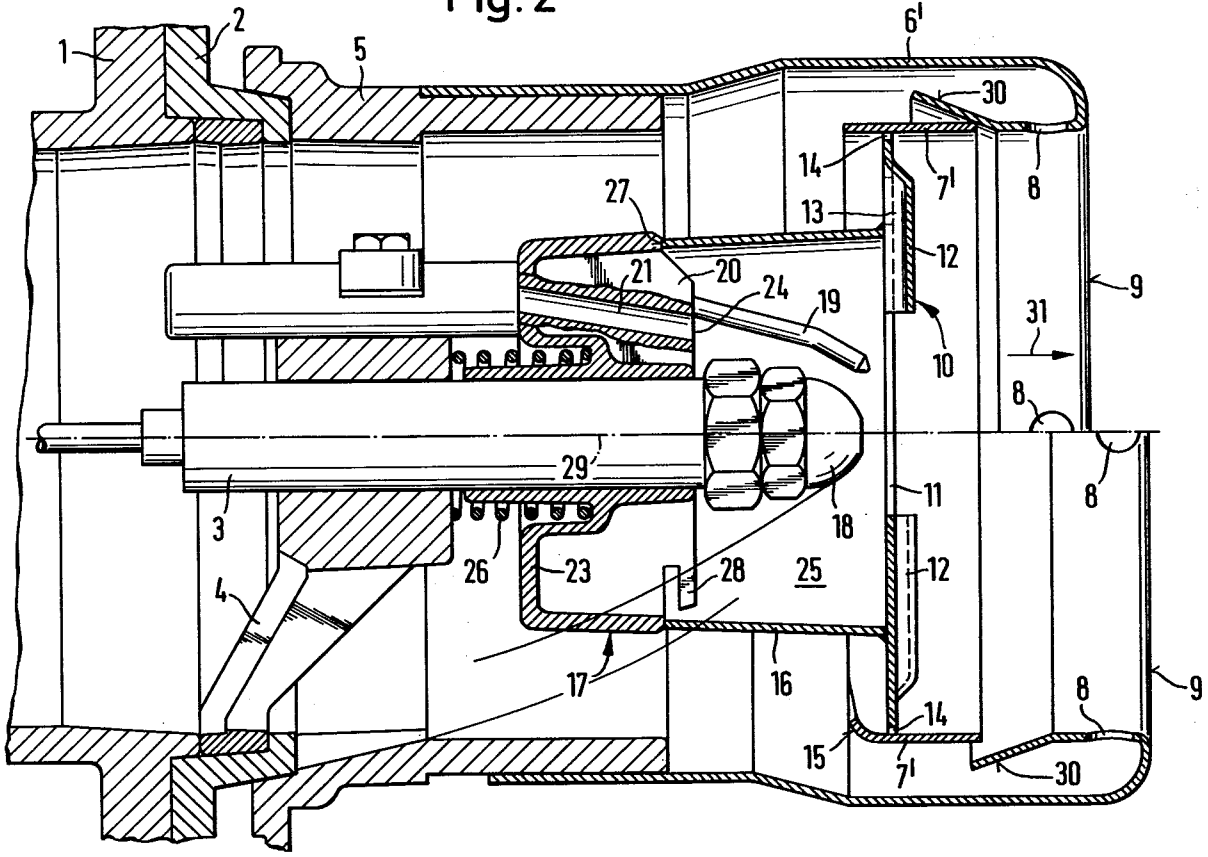
FIG. 2 shows a cross-section through a burner head for higher outputs; the upper half of FIG. 2 shows the construction of a burner head for 1.8 kg/hr while the lower half shows the burner in the position where 10 kg/hr can be consumed.

The embodiment of FIG. 2 is based on the embodiment of FIG. 1 and hence most parts correspond to those of the embodiment of FIG. 1 and have the same reference numerals. The difference is only in the construction of the shell in active connection with the baffle plate 10. The shell 7 of FIG. 1, in the embodiment of FIG. 2 is shorter and designated as 7'. It no longer is one unit with the air supply pipe. The air supply pipe 6' of the FIG. 2 embodiment has an outwardly directed expansion in the plane of the atomizer jet 18, because in this case the inwardly directed air supply pipe with its radial openings 8 turns into an end cone 30 diverging in the upstream direction; this end cone, together with shell 7', forms an annular (circular) slot if the air supply pipe 6' is displaced downstream in the direction of arrow 31. If, as shown in the upper half of FIG. 2, the shell 7' contacts end cone 30, and no gap is between these parts, oil quantities of 1.8 to 3.0 kg/hr can be burnt without difficulty and without disadvantages. If the air supply pipe 6' is shifted in the direction of arrow 31 by a relatively small amount, 4 to 5 kg/hr can be burnt. The more the air supply pipe 6' is shifted in the direction of arrow 31, the more oil can be burnt so that in the position shown on the bottom of FIG. 2, 8 to 10 kg/hr can be burnt.

If the burner head were designed as shown in the upper half of FIG. 2 and if the slots 14 absolutely necessary for burning relatively large oil quantities were closed, relatively small oil quantities, for example, 1 kg/hr could be burnt with this burner head.

During manufacture, the baffle plate 10, the hollow cylindrical part 7, and the air supply pipe 6 of the embodiment of FIG. 1 may be each one piece; these pieces are then joined. However, the baffle plate 10 and the hollow body 7 can be made in one piece, and the slots 14 can be punched out from the bottom of this potlike body as necessary. The same applies to the embodiment of FIG. 2.

We claim:

1. A burner for liquid fuel comprising: an air supply pipe with discharge opening; at least one pressure atomizer jet having a discharge opening and located concentrically in said air supply pipe; a combustion chamber; a pot-shaped means located between the discharge opening of said air supply pipe and the discharge opening of said jet and being open towards said combustion chamber; said pot-shaped means having a shell with radial openings and extending to the discharge opening of said air supply pipe and closing said discharge opening of said air supply pipe; said pot-shaped means having a bottom forming a baffle plate with a center opening and radial slots extending therefrom; ignition electrodes; a pot-shaped member upstream of said baffle plate and enclosing a space containing said atomizer jet and said ignition electrodes; pipe means; said pot-shaped member having bottom means penetrated by said pipe means, said pipe means having a discharge opening located upstream of and between said ignition electrodes; said pot-shaped member having a rim diameter substantially smaller than the diameter measured by outer ends of said radial slots and larger than a diameter of said center opening of said baffle plate.

2. A burner as defined in claim 1 including slot means extending in a peripheral direction between said shell having said radial openings and the edge of the bottom of said pot-shaped means forming said baffle plate.

3. A burner as defined in claim 1 wherein said pot-shaped means terminates said air supply pipe and has two parts, one of said parts comprising part of said shell and said bottom forming said baffle plate, the other one of said parts comprising a portion of said shell having said radial openings and being connected on one end to said air supply pipe and being axially displaceable therewith, said other part having another end facing said baffle plate and having an end cone expanding in an upstream direction.

4. A burner as defined in claim 1 said pot-shaped member has two parts, one of said parts being fastened to said baffle plate, spring means, the other of said parts being displaceable into contact with said one part of said pot-shaped member under action of said spring means.

* * * * *